US007381437B2

(12) United States Patent
Brander

(10) Patent No.: US 7,381,437 B2
(45) Date of Patent: Jun. 3, 2008

(54) EDGE STACKABLE ABSORBENT DISPLAY CONTAINER

(76) Inventor: William M. Brander, 6399 Allison Ct., Douglasville, GA (US) 30134

( * ) Notice: Subject to any disclaimer, the term of this patent is extended or adjusted under 35 U.S.C. 154(b) by 465 days.

(21) Appl. No.: 10/853,618

(22) Filed: May 25, 2004

(65) Prior Publication Data

US 2004/0211682 A1 Oct. 28, 2004

(51) Int. Cl.
*B65B 25/06* (2006.01)
*B65D 81/26* (2006.01)

(52) U.S. Cl. ..... 426/129; 206/204

(58) Field of Classification Search ..... 206/204, 206/503, 504, 515, 518, 557, 561, 524.1, 206/524.3, 524.4; 229/87.11, 406, 407; 220/23.83; 426/121, 129, 106; 99/646 C
See application file for complete search history.

(56) References Cited

U.S. PATENT DOCUMENTS

| | | | | | |
|---|---|---|---|---|---|
| 3,371,848 | A | * | 3/1968 | Ward et al. | 220/270 |
| 3,409,199 | A | * | 11/1968 | Lake | 229/407 |
| 3,834,606 | A | | 9/1974 | Andersson | 229/2.5 |
| 3,989,867 | A | | 11/1976 | Sisson | 428/132 |
| 4,321,997 | A | | 3/1982 | Miller | 206/204 |
| 4,382,507 | A | | 5/1983 | Miller | 206/204 |
| 4,410,578 | A | | 10/1983 | Miller | 428/117 |
| 4,415,086 | A | * | 11/1983 | Bennett, Jr. | 206/564 |
| 4,442,969 | A | | 4/1984 | Holden | 229/2.5 |
| 4,552,600 | A | | 11/1985 | Laiewski et al. | 156/73.1 |
| 4,702,377 | A | | 10/1987 | Gröne | 206/557 |
| 4,742,908 | A | | 5/1988 | Thomas, Jr. et al. | 206/204 |
| 4,815,590 | A | | 3/1989 | Pepiatt et al. | 206/204 |
| 4,861,632 | A | | 8/1989 | Caggiano | 428/35.2 |
| 4,949,897 | A | | 8/1990 | Pawlak et al. | 229/2.5 |
| 4,984,907 | A | | 1/1991 | Power | 383/109 |
| 5,135,787 | A | | 8/1992 | Bair | 428/36.1 |
| 5,176,930 | A | | 1/1993 | Kannankeril et al. | 426/124 |
| 5,361,465 | A | | 11/1994 | O'Donnell | 27/29 |
| 5,552,169 | A | | 9/1996 | Kannankeril et al. | 426/107 |
| 5,660,868 | A | | 8/1997 | Yeager | 426/124 |
| 5,709,089 | A | | 1/1998 | Dawson et al. | 42/4 |
| 5,709,897 | A | | 1/1998 | Pearlstein | 426/106 |
| 5,720,999 | A | | 2/1998 | Lanzani et al. | 426/129 |
| 5,820,955 | A | | 10/1998 | Brander | 428/35.7 |
| 6,152,295 | A | | 11/2000 | Brander et al. | 206/204 |
| 2003/0057114 | A1 | | 3/2003 | Brander | 206/204 |

FOREIGN PATENT DOCUMENTS

| | | |
|---|---|---|
| DE | 40 39 354 | 12/1990 |
| DE | 42 34 632 | 10/1992 |
| FR | 2 402 599 | 9/1978 |

* cited by examiner

*Primary Examiner*—J. Gregory Pickett
(74) *Attorney, Agent, or Firm*—Thomas, Kayden, Horstemeyer & Risley, LLP

(57) ABSTRACT

An edge stackable absorbent display container (10) includes an open-top tray (14) that has an array of liquid receiving cavities (A-I) formed by intermediate longitudinal and laterally extending support ribs (36, 37, 38 and 39). The side cavities (A, B, C and G, H and I) are sloped with respect to the central cavities (D, E and F), forming the tray bottom wall (22) in a spread U-shape that enhances the tilting of the tray. Liquid absorbent material (56) is placed in at least some of the cavities (A-I), and a porous sheet (16) is supported over the cavities on the support ribs and the sheet support rim (60). Liquid from the product, such as raw poultry, can drain through the porous sheet and become absorbed by the absorbent material.

26 Claims, 3 Drawing Sheets

EDGE STACKABLE ABSORBENT DISPLAY CONTAINER

BACKGROUND OF THE INVENTION

The present invention generally relates to containers for storing and displaying foods and other products that bear liquids and that are likely to exude liquids while stored and displayed. More particularly, the present invention relates to an edge stackable absorbent container for displaying products that exude liquids.

Excess moisture within food storage containers can cause premature spoilage of the food products that are stored in the containers because the moisture provides a favorable environment for the growth and reproduction of microorganisms. Excess moisture in a food storage container also can lead to leakage of fluids from the storage container that can cause contamination of other foods and items about the container.

Attempts at controlling excess moisture in food storage containers, such as trays (both rigid and flexible) and bags, have met with some success. The prior art devices include (1) pre-formed trays configured for the insertion of absorbent pads or absorbent sheets with the food products resting on the absorbent pads and sheets; (2) trays with built-in reservoirs arranged to trap excess moisture exuded from the products, with some of the trays including a porous cover over the reservoirs that allows fluids to drain from the product to the cover into the reservoir, but which partially restricts the fluids from re-emerging past the cover following shaking or movement of the trays; and (3) trays or packs made from multiple layers of material with one layer being liquid impervious and a second layer being liquid pervious to allow foods to enter, and an absorbent media sandwiched between the two layers to absorb and retain the entering fluids.

There is a desire in supermarkets and other places to display foods in disposable trays having a transparent cover with the trays arranged in a shingle stack. A shingle stack refers to several trays that are edge stacked on shelves so that the trays with a product are tilted forward for better viewing by the customer. This is particularly attractive for foods like chicken parts. Unfortunately, many products that exude liquids, such as chicken, will exude so much liquid that when the tray is tilted, the liquid naturally flows toward the lower-most side wall of the tray, creating an undesirable liquid pool. This might occur even with trays that have absorbent material in the bottom of the tray, because there might be liquid on the upper side of the food product that has not flowed to the bottom of the tray, or the food product has been frozen or partially frozen and ice has formed on the upper surface of the food product and does not melt and flow off the food product until the tray and food product have been tilted. This tends to result in the liquid flowing to the lower edge of the tray instead of to the bottom of the tray, making an undesirable pool of liquid and blood that is visible in the package. Also, if more liquid has accumulated in the bottom of the tray than can be absorbed by the absorbent material, there can be run-off of the excess liquid from the bottom of the tray into the lower edge of a tilted tray. Simply putting more absorbent material in the bottom of the tray does not always solve this problem as any unabsorbed liquid still tends to flow toward the bottom side wall when the tray is tilted.

Accordingly, there exists a need for an edge stackable absorbent container for displaying products that exude liquid that avoids the above noted shortcomings of the prior art.

SUMMARY OF THE INVENTION

Briefly stated, the present invention relates to edge stackable absorbent containers for storing and displaying foods and other products that bear liquids that are likely to accompany or be exuded from the products. In a preferred embodiment, the absorbent container includes a tray having a bottom wall and surrounding side walls extending upwardly from the bottom wall, with the bottom wall having a central portion and opposed side portions, support ribs formed in the bottom wall and extending upwardly between the central portion and opposed side portions and forming at least one cavity in the central portion and at least one cavity in each of the side portions. The side cavities are tilted with respect to the central cavity so that the bottom wall of the tray is shaped in a spread U-shaped configuration. Liquid absorbent material is placed in the cavities of the tray, and a porous sheet is applied to the support ribs and extends over the cavities of the tray, confining the liquid absorbent material to the cavities. The products that bear liquid are placed on the porous sheet and are supported by the support ribs, and a liquid impervious sheet is applied to the tray, over the product and adhered to the surrounding side wall of the tray, enclosing the product in the tray.

With this arrangement, the container may be tilted to rest on the sloped bottom wall of the side cavity, and any liquid exuded from the product passes through the porous sheet into a cavity and becomes absorbed by the absorbent material in the cavity.

Preferably, the absorbent material in the cavities of the tray is a gel-forming material when contacted by the liquid from the product. The gel cannot pass back through the porous sheet, so that the liquid, in a gel form, is confined in the cavities, away from the food product. This tends to minimize the deterioration of the food product over time.

Also, the tilting of the tray and the food product confined in the container, provides a desirable display of the food product, and the liquid exuded from the food product is drained through the porous sheet and is out of sight to the customer that views the container and its food product.

With this arrangement, it is likely that the customer is not going to be able to view the liquid that has passed through the porous sheet and absorbed by the absorbent material until the container is opened. Even then, the customer is likely to discard the container before observing any of the gel that is formed by contact of the liquid with the absorbent material beneath the porous sheet.

By sloping the side cavities with respect to the central cavities of the tray, the absorbent container can be edge stacked with a substantial amount of the weight of the food product resting on the side cavity, thereby applying only a minimal amount of stress to the remaining portions of the tray. The remaining weight is likely to be applied to the next adjacent container at a position over its lower-most side cavity, so that substantially all of the weight of the food product is applied to its own lower-most side cavity and the lower-most side cavity of the next adjacent tray, thereby reducing stress in the tray and also providing the desired tilted configuration of the edge stacked trays in the supermarket display case.

While the invention is directed primarily to food products that exude or bear liquid, it will be understood that the product to be placed in the absorbent container can be different types of food products, can be products other than food products, without limiting the scope of the invention.

Various types of absorbent materials can be used with the edge stackable tray, such as blends of at least one non-crosslinked gel forming polymer, at least one clay, and at least one trivalent cation. In addition, the composition can include diatomaceous earth in place of some of the clay. Further, natural gums such as xanthan, guars, and alginates can be added as can organic buffers. The absorbency of the blend exceeds the sum of the absorbencies of the individual components of the blend.

The gel that is formed as a result of the absorbency of the liquid has high gel strength and exhibits a low level of gel block effect. In the case of food packaging applications, all components of the blend can be selected from materials known to be regulated by FDA as GRAS (generally regarded as safe) for incorporation in foods. The absorbent material of this invention is believed to be the only food safe absorbent that also provides the necessary gel strength and absorbency criteria for food packing applications.

The non-crosslinked gel forming polymer can include cellulose derivatives, such as CMC and salts thereof, hydroxyethylcellulose, and methylcellulose, hydroxypropyl-methylcellulose, and also gelatinized starches, gelatin, dextrose, and the like, and mixtures thereof. The clay component can include attapulgite, montmorillonite (including bentonite clays), bectorite, sericite, kaolin, and mixtures thereof. A portion of the clay can be replaced with diatomaceous earth. The trivalent cation can be derived from aluminum sulfate, potassium aluminum sulfate, and other soluble salts of trivalent metal ions such as aluminum, chromium, and the like. The inorganic buffer can be one such as sodium carbonate (soda ash), sodium hexametaphosphate, sodium tripolyphosphate, and the like.

A method of agglomeration of the blend is described which enhances the rate of absorbency as well as increases the maximum total absorbency of the material and improves the strength of the gel formed on hydration of the material. Structures for absorbent articles prepared from absorbent material are described.

The new type of container for fresh foods, etc. is described which incorporates the absorbent material. The absorbent material, such as that disclosed herein, is trapped in the cavities of the tray, beneath the porous sheet that is applied to the support ribs that form the cavities.

DETAILED DESCRIPTION

Figure 1:
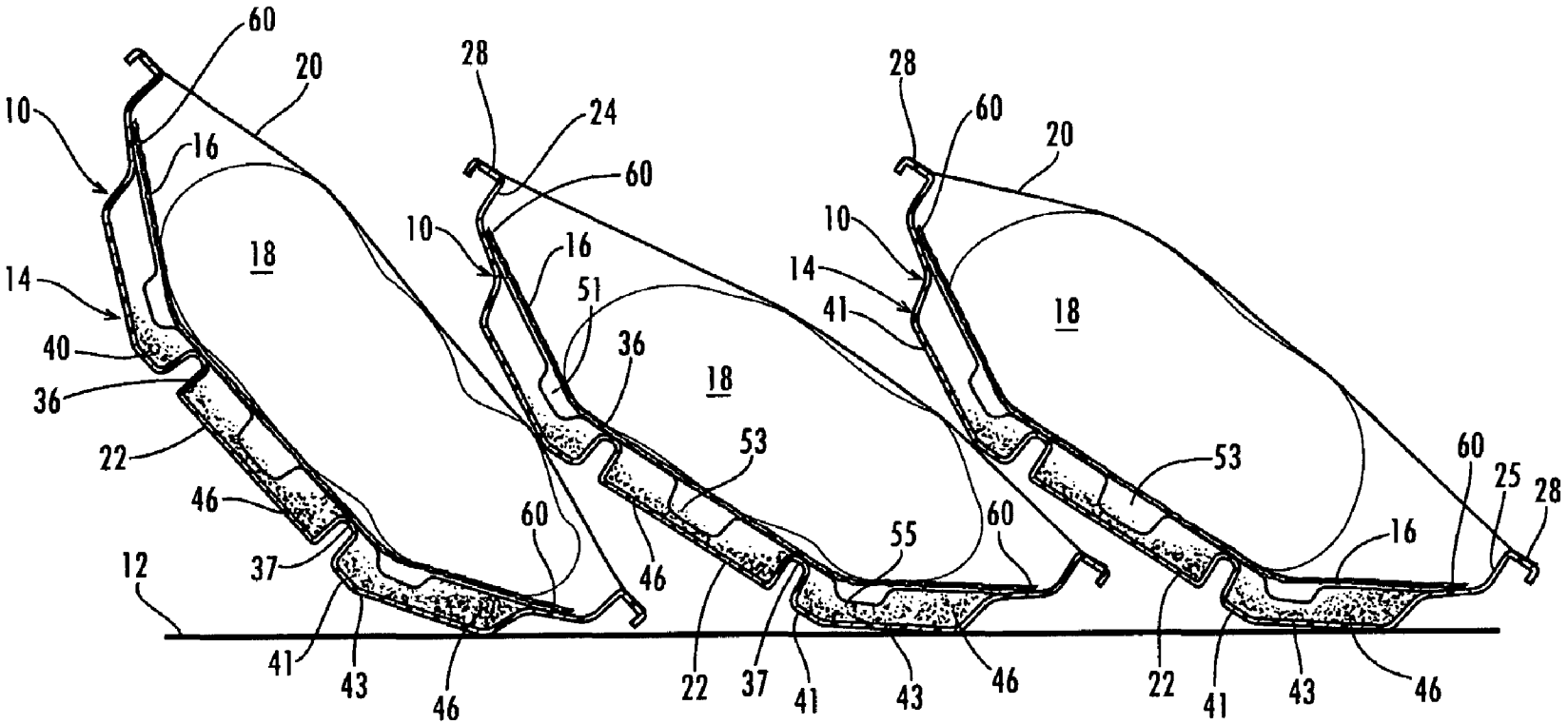
FIG. 1 is a side view, in cross section, of a plurality of the edge stacked absorbent containers, showing them in their edge stacked configuration.

Referring now in more detail to the drawings in which like numerals indicate like parts throughout the several views, FIG. 1 illustrates three duplicate containers 10 that are arranged in edge stacked, overlapping relationship on a horizontal support 12 of a refrigerated display case in a supermarket, etc. Each container 10 includes an open-topped tray 14, a porous sheet 16, a product 18 that bears or exudes a liquid, and a liquid impervious cover sheet 20 extending over the product 18 and adhered to the tray.

Figure 2:
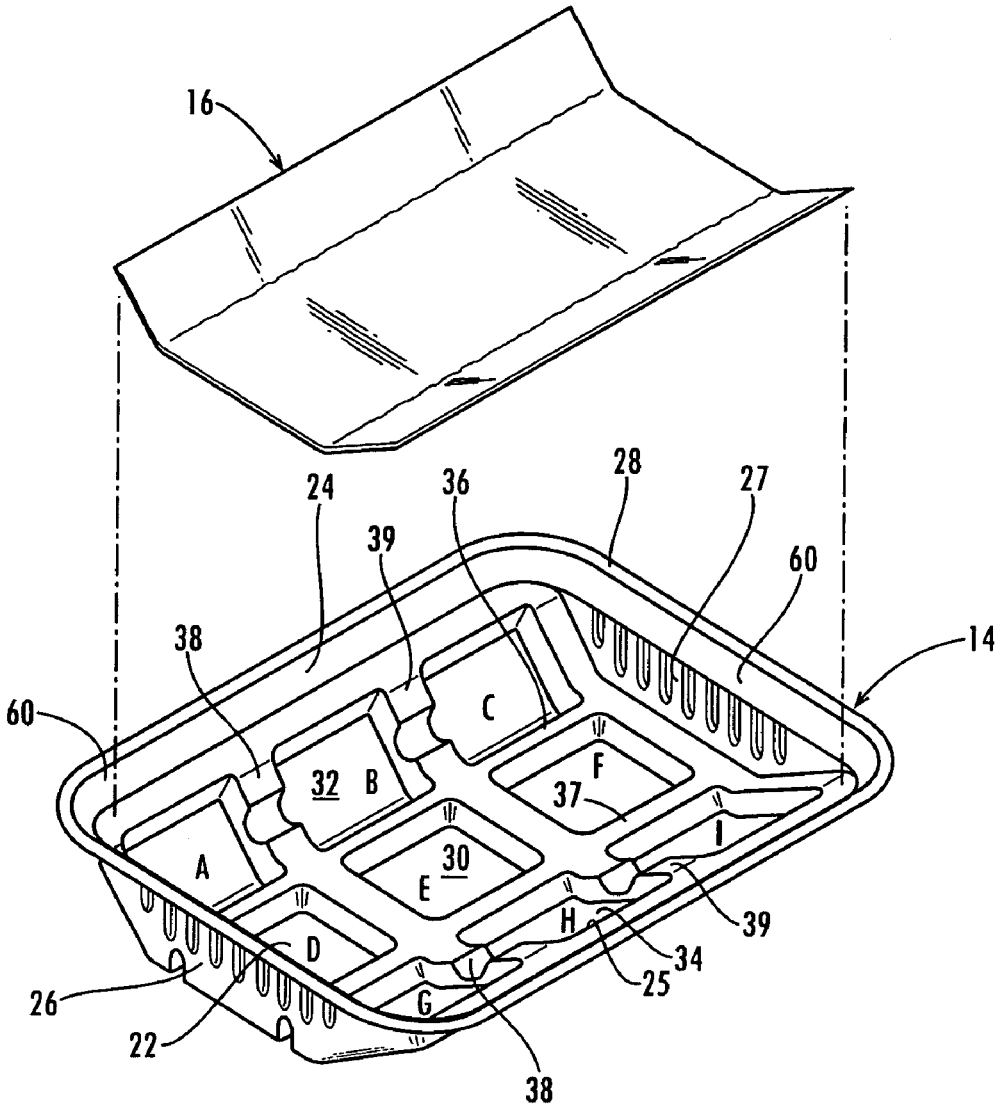
FIG. 2 is an expanded view of one of the edge stackable absorbent containers, showing the tray and the porous sheet expanded away from the tray, indicating in dash lines how the porous sheet is applied to the tray.
Figure 3:
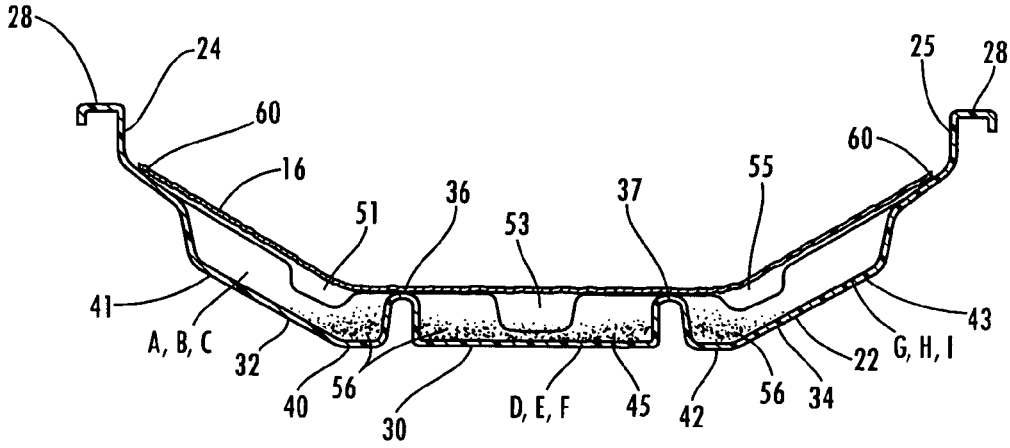
FIG. 3 is a side cross-sectional view of one of the edge stackable trays, showing the absorbent material in the cavities of the tray and the porous sheet applied over the cavities.
Figure 4:
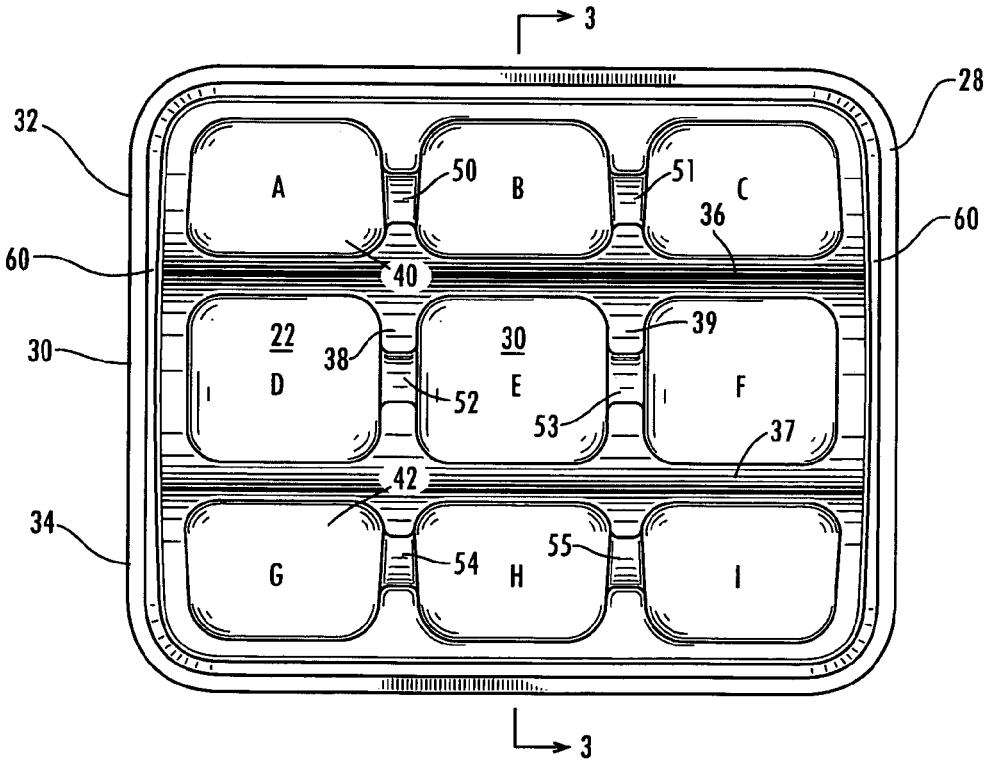
FIG. 4 is a plan view of the tray of FIG. 3.

As illustrated in FIGS. 2-4, the tray 14 includes a tray bottom wall 22 and surrounding side walls 24 and 25 and end walls 26 and 27 that extend upwardly from the bottom wall and terminate in the continuous upper edge 28.

Bottom wall 22 has a central portion 30 and opposed side portions 32 and 34 on opposite sides of the central portion. Longitudinal support ribs 36 and 37 extend upwardly from the tray bottom wall and along the length of the tray and distinguish the central portion 30 of the tray from the side portions 32 and 34 of the tray. Cross support ribs 38 and 39 extend upwardly from the tray bottom wall and across the longitudinal support ribs.

The grid of longitudinal support ribs 36, 37 and lateral support ribs 38 and 39 subdivide the tray bottom wall 22 into a geometrical array of upwardly facing cavities A, B, C, D, E, F, G, H, and I. Cavities A, B, and C are positioned in side portion 32 of the tray bottom wall 22, and cavities G, H, and I are positioned in the opposed side portion 34 of the tray bottom wall, and each cavity has its own cavity bottom wall that, together, form the bottom wall of the tray.

As shown in FIG. 3, the side cavities A, B and C are sloped upwardly from the central cavities D, E and F that are in the central portion 30 of the tray, while the opposed side cavities G, H, and I are sloped in the opposite upward direction from the central cavities D-F. This forms the tray bottom wall 22 in the shape of an open or spread U-shape, with the bottom walls of the cavities A, B and C sloped upwardly from the bottom walls of cavities D, E and F, and the bottom walls of the cavities G, H and I sloped upwardly from bottom walls of cavities D, E and F.

It will be noted that the side cavities A, B, C and G, H, I all include lower portions adjacent the central cavities D, E and F, such as lower portion 40 for each of the side cavities A, B and C and at 42 for the side cavities G, H and I. The upper portions 41 and 43 of the cavities A, B and C and G, H and I, respectively, are sloped upwardly from the lower portions. The lower portions 40 and 42 of the side cavities are in the same plane as the central cavities bottom walls 45. Thus, the weight of the tray will be borne principally by the upper portions 41 and 43 of the side cavities when the tray is edge stacked as shown in FIG. 1.

Drain notches 50, 51, 52, 53, 54 and 55 are formed in the cross support ribs 38 and 39.

Sheet support rim 60 extends about the cavities A-I adjacent the side walls and end walls of the tray. The sheet support rim 60 is coextensive with the longitudinal and cross support ribs 36-39 forming a smooth surface for attaching the porous sheet 16 inside the side walls of the tray and to the upper exposed surfaces of the support ribs. The sheet support rim 60 is sloped upwardly in the side portions of the tray to be coextensive with and level with the adjacent portions of the support ribs support ribs 38 and 39.

A liquid absorbent material 56 is placed in at least some of the cavities A-I of the tray. The absorbent material can be the type of material described above. Typically, the absorbent material is in a granular form and can be sprinkled into the open-top cavities.

After the absorbent material has been placed in the cavities, the porous sheet 16 is applied by adhesive or other conventional means to the tray by attaching the porous sheet to the sheet support rim 60 and to the upper surfaces of the support ribs 36, 37, 38 and 39.

By placement of the porous sheet 16 as described and as shown in FIG. 1, the absorbent material is trapped beneath the porous sheet 16. The mesh of the porous sheet is small enough so as to contain the granular material in the cavities substantially without losing the granular material.

As best seen in FIG. 3, the drain notches, such as notches 51, 53 and 55, are recessed beneath the porous sheet 16 so that the absorbent material can pass from one cavity to the other cavity along the length of the tray.

When the tray 14, its absorbent material 56 and porous sheet 16 are assembled as shown in FIG. 3, the assembly is ready for use. The tray assembly can be originally supplied in stacked, nested relationship, with one tray stacked upon the other. The sloped configuration of the side walls and end walls allows an upper tray to rest on a lower tray, with the tray bottom wall resting on the porous sheet 16 of the tray next below.

When the trays are to be loaded with product, they are separated from their nested relationship and a product 18 (FIG. 1), such as a raw poultry part or parts are placed in the tray, against the porous sheet 16, with the weight of the product 18 being borne principally by the support ribs 36, 37, 38 and 39. A flexible liquid impervious sheet 20 is applied over the product 18, with the edges of the sheet applied to the upper edge 28 of the side walls and end walls. This seals the product 18 in the container 10.

When the product is to be displayed at a grocery store or other location, several of the products can be edge or "shingle" stacked as shown in FIG. 1. The sloped upper portions 41 or 43 of the side cavity bottom walls usually will engage the floor 12 of the refrigerated display case and bear the weight of the products 18. More specifically, the side cavity upper bottom wall portions 41 or 43 will support a portion of its own product and will support a portion of the next adjacent product. This applies substantially all of the weight of the containers to the weight bearing side cavity bottom wall portions 41 or 43.

In the meantime, liquid draining from the products 18 tend to move by gravity downwardly about the product 18 and through the porous sheet 16, draining into the cavities A-I. The support ribs maintain the product above the absorbent material 56, leaving the absorbent material free to expand without engaging the product.

The loose nature of the absorbent material tends to allow gravity to move the absorbent material to the lower parts of each cavity A-I. This is the same location where gravity tends to move the liquid draining from the product 18 within the container.

While various absorbent material can be used, the preferred absorbent material is a gel-forming material, described above. When the liquid reaches the absorbent material, it forms a gel 46. The gel is of a size and consistency that does not pass through the porous sheet 16. Thus, the porous sheet 16 separates the drained liquid away from the product 18. Furthermore, the suspension of the product 18 by the support ribs 36, 37, 38 and 39 above the absorbent material helps to keep the liquid in the gel from re-contacting the product 18.

The open U-shaped configuration of the tray bottom wall 22 allows the tray to be tilted more readily than it would be if the bottom wall of the tray were of conventional rectangular shape. Moreover, the arrangement of the sloped side cavity bottom walls allows maximum tilting of the tray with minimum lifting of height of the opposite edge of the tray, thereby avoiding inadvertent front tipping of the tray and a natural tendency of the tray to maintain either its shingle stacked relationship or, when not supported by an adjacent tray, lying flat on the floor of the refrigerated display case.

The presence of the drain notches 50-55 permits drainage of excess unabsorbed liquid between the cavities of each row. However, it will be noted that there is an absence of drain notches across the longitudinal support ribs. This avoids the tendency of the liquid to rush to the lower-most side cavity when the container is arranged in its shingle stacked configuration of FIG. 1.

Although a preferred embodiment of the invention has been disclosed in detail herein, it will be obvious to those skilled in the art that variations and modifications of the disclosed embodiment can be made without departing from the spirit and scope of the invention as set forth in the following claims.

I claim:

1. An edge stackable absorbent container for displaying a product that exudes liquid, comprising:

a tray having a tray bottom wall and surrounding side walls extending upwardly from said tray bottom wall, said tray bottom wall having a central portion and opposed side portions on opposite sides of said central portion, a grid of longitudinal support ribs and lateral support ribs formed in said tray bottom wall that subdivide said tray bottom wall into an array of upwardly facing cavities and form at least one central cavity in said central portion of said tray bottom wall and at least one side cavity in each of said side portions of said tray bottom wall, with said central cavity including a central cavity bottom wall and said side cavities including side cavity bottom walls, said central cavity bottom wall and said side cavity side walls forming said tray bottom wall, said central cavity bottom wall extending in a bottom wall plane and said side cavity bottom walls having at least a portion thereof sloped upwardly from said bottom wall plane such that said central and side cavities and said central and side cavity bottom walls are formed in a spread U-shaped configuration, liquid absorbent material in at least one of said central and side cavities, and a porous sheet applied to said support ribs and extending in a spread U-shape over said central and side cavities, a product that exudes liquid placed on the porous sheet and supported by the support ribs, and a liquid impervious sheet applied to the tray over the product and adhered to the surrounding side wall enclosing the product in the tray, such that the container may be tilted and supported on a horizontal surface by one of its said side cavity bottom walls with the central cavity bottom wall tilted up away from the horizontal surface and any liquid exuded from the product passes through the porous sheet to a cavity and becomes absorbed by the absorbent material in the cavity.

2. The edge stackable absorbent container of claim 1, wherein said support ribs extend through said bottom wall and define a plurality of central cavities in said central portion of said bottom wall.

3. The edge stackable absorbent container of claim 1, wherein said support ribs extend through said bottom wall and define said plurality of side cavities in each of said side portions of said bottom wall.

4. The edge stackable absorbent container of claim 3, wherein said support ribs include recesses therein and said porous sheet spans said recesses and forms a passage for liquid and absorbent between said cavities without requiring the liquid or absorbent to pass over a rib to reach an adjacent cavity.

5. The edge stackable absorbent container of claim 1, wherein said side cavity bottom walls of said side cavities each have a lower portion in said bottom wall plane and a sloped portion that extends sloped upwardly from said lower portion, said sloped portion of said side cavity bottom walls forming a support for the container when edged stacked, and said lower portion of said side cavity bottom walls forming a support for the container when the container rests on said central cavity bottom wall.

6. The edge stackable absorbent container of claim 1, wherein said absorbent material is a blend of at least one non-cross linked gel-forming polymer, at least one clay and at least one trivalent cation.

7. The edge stackable absorbent container of claim 6, wherein said absorbent material further includes diatomaceous earth in place of some of the clay.

8. The edge stackable absorbent container of claim 1, wherein said support ribs include a longitudinal rib extending parallel to the central side cavities.

9. The edge stackable absorbent container of claim 1, wherein said surrounding side walls include a continuous upper edge, and said tray includes a support rim at said surrounding side walls displaced from said continuous upper edge, said support rim being coextensive with said support ribs and formed in a spread U-shaped configuration, and said porous sheet applied to said support rim and to said support ribs in a spread U-shaped configuration.

10. An edge stackable absorbent container for displaying a product that exudes liquid, comprising:

a tray having a tray bottom wall and surrounding side walls extending upwardly from said tray bottom wall, said tray bottom wall having a central portion and opposed side portions on opposite sides of said central portion, support ribs formed in said tray bottom wall and extending upwardly between said central portion and said opposed side portions and forming at least one central cavity in said central portion of said tray bottom wall and at least one side cavity in each of said side portions, said central cavity having a central cavity bottom wall and said side cavities each having a side cavity bottom wall, said side cavity bottom walls having a lower portion in the same plane as the bottom wall of said central cavity and a portion thereof sloped upwardly with respect to said central cavity bottom wall such that said central cavity and said side cavities shaped in a spread U-shaped configuration, liquid absorbent material in at least one of said side cavities, and a porous sheet applied to said support ribs and extending in a spread U-shape over said central and side cavities, such that the container may be tilted to rest on a side cavity bottom wall and any liquid exuded from the product passes through the porous sheet to a cavity and becomes absorbed by the absorbent material in the cavity.

11. The edge stackable absorbent container of claim 10, wherein a product that exudes liquid is supported by the ribs and liquid has exuded from the product and has passed through the porous sheet to the absorbent material and has been absorbed by the absorbent material and formed a gel that cannot pass through the porous sheet.

12. The edge stackable absorbent container of claim 10, and further including a support rim formed in a spread U-shape and positioned at said surrounding side walls and coextensive with said support ribs, said porous sheet supported by said support rim.

13. An edge stackable absorbent container for displaying a product that exudes liquid, comprising:

a tray having a bottom wall and surrounding side walls extending upwardly from said bottom wall, said tray bottom wall having a central portion and opposed side portions on opposite sides of the central portion, said opposed side portions of said bottom wall sloped upwardly from said central portion of said bottom wall such that said bottom wall is of a spread U-shape, a grid of support ribs defining an array of upwardly facing cavities formed on said central portion and on said sloped side portions of said tray bottom wall, said ribs and said array of cavities formed in a spread U-shape, absorbent gel-forming material in at least some of said cavities, a porous sheet applied to said support ribs and extending in a spread U-shape over the cavities, such that when the container rests on one of the sloped opposed side portions of its bottom wall when edge stacked the central portion of the bottom wall becomes sloped upwardly therefrom, and liquid exuded from a product in the container passes through the porous sheet into a cavity and contacts the absorbent gel-forming material and forms a gel that cannot pass back through the porous sheet to the product.

14. A container for storing and displaying liquid exuding products comprising:

a rectangular tray having a tray bottom wall and surrounding opposed side walls and end walls extending upwardly from said bottom wall and forming a continuous upper edge, an array of support ribs extending upwardly from said tray bottom wall and defining an array of upwardly facing central cavities and side cavities, said side cavities positioned on opposite sides of said central cavities and adjacent said side walls, said side and central cavities each having cavity bottom walls that form portions of the tray bottom wall, the cavity bottom walls of the side cavities are sloped with respect to the cavity bottom walls of said central cavities such that the bottom wall of the tray and the array of support ribs are formed in a spread U-shape, liquid absorbent material positioned in at least some of said side cavities, a porous sheet applied to said support ribs in a spread U-shape and extending over the cavities that have liquid absorbent material therein, a liquid exuding product placed on the porous sheet and supported by the support ribs, and a transparent sheet is applied over the product and secured to the upper edge of the tray, such that when the container is supported on a horizontal surface in a sloped attitude on the cavity bottom walls of one of the side cavities, the central cavities are sloped up from the horizontal surface and liquid exuded from the product passes through the porous sheet to the cavities and to the absorbent material and is absorbed by the absorbent material.

15. The container for storing and displaying liquid exuding products of claim 14, wherein the absorbent material is gel-forming when contacted by a liquid, and said container being configured so that when said tray is shingle-stacked with other similar trays with a side liquid collection cavity positioned lowermost, the interior ribs support the liquid exuding product and limit the application of the weight of the liquid exuding product against the absorbent material.

16. The container of claim 15 wherein the absorbent material is located in all of said liquid collection cavities.

17. The container of claim 14, wherein said sheet of porous material is adhered to said ribs of said tray and contains said absorbent material in all of said liquid collection cavities.

18. The container of claim 14, wherein one of said side liquid collection cavities is positioned at the lower most position with respect to the tray when said tray is shingle-stacked on its side.

19. The container of claim 14, wherein the side walls and end walls slope outwardly from the base wall as they extend upwardly so that trays can be nested together with the liquid absorbent placed in the cavities of the trays and a porous sheet placed on the ribs of each tray and when stacked without the liquid exuding products and the transparent sheet.

20. The container of claim 14, wherein drain notches are formed in said side ribs, with said drain notches extending beneath said porous material for allowing liquid to pass through the drain notches without passing back through the porous sheet.

21. The container of claim 14, wherein said absorbent material consists essentially of:

at least one non-crosslinked gel-forming water soluble polymer having a first absorbency, said first absorbency being defined by weight of liquid absorbed/weight of said at least one non-crosslinked gel forming polymer, said at least one non-crosslinked gel forming polymer being food safe;

at least one mineral composition having a second absorbency, said second absorbency being defined by weight of liquid absorbed/weight of said at least one mineral composition, said at least one mineral composition being food safe; and at least one soluble salt having at least one trivalent cation, said at least one soluble salt having at least one trivalent cation being food safe, the absorbency of said absorbent composition of matter exceeding a sum of said first absorbency and said second absorbency, said absorbent composition of matter being compatible with food products such that said absorbent composition of matter is food safe when in direct contact with the food products.

22. The container of claim 14, wherein said absorbent material consists essentially of a synthetic cross-linked polymer.

23. The container of claim 14, wherein said absorbent material consists essentially of sodium polyacrylate.

24. The container of claim 14, wherein at least one drain notch is formed in said support ribs and said drain notch is spaced from said porous sheet for allowing liquid to pass across said side rib without passing back through said porous sheet.

25. The container of claim 14, wherein said support ribs comprises a side rib adjacent all of said side walls.

26. A process for collecting a liquid exuding from or accompanying a product contained in a tray and forming the liquid into a gel away from the product and preventing the gel from migrating back to the product, said process comprising:

the liquid into a gel away from the product and preventing the gel from migrating back to the product, said process comprising:

providing a tray for displaying said product, said tray having a bottom wall and side walls, support ribs extending upwardly from the bottom wall and forming at least one central liquid collection cavity and side liquid collection cavities on opposite sides of the central liquid collection cavity, the side liquid collection cavities sloped upwardly from the central liquid collection cavity such that the bottom wall, support ribs and liquid collection cavities are in the shape of a spread U-shape, placing an absorbent material in said side liquid collection cavities, applying a porous sheet to said support ribs and extending said porous sheet in a spread U-shape over said side liquid collection cavities, retaining the absorbent material in said side liquid collection cavity with said porous sheet, placing a liquid exuding product in said tray, covering said liquid exuding product with a cover and connecting said cover to said tray, shingle-stacking the tray with other similar trays by tilting said tray and supporting the tray on one of the side liquid collection cavities with the central liquid collection cavity extending upwardly from the supporting side liquid collection cavity, draining liquid exuded from said liquid exuding product downwardly into the supporting side liquid collection cavity, absorbing with said absorbent material the liquid drained from said liquid exuding product into the supporting side liquid collection cavity and forming a gel of the liquid, and preventing the gel from passing back through said porous sheet.

* * * * *